US006082158A

United States Patent [19]

Wegner

[11] Patent Number: 6,082,158

[45] Date of Patent: Jul. 4, 2000

[54] CLOSING DEVICE

[75] Inventor: Torsten Wegner, Wiesbaden, Germany

[73] Assignee: Mannesmann VDO AG, Frankfurt, Germany

[21] Appl. No.: 08/995,066

[22] Filed: Dec. 19, 1997

[30] Foreign Application Priority Data

Dec. 21, 1996 [DE] Germany ..... 196 53 760
Dec. 12, 1997 [DE] Germany ..... 197 55 207

[51] Int. Cl.[7] ..... E05B 47/00

[52] U.S. Cl. ..... 70/277; 70/278.7; 292/201; 292/DIG. 23

[58] Field of Search ..... 70/277, 278.7; 292/201, 215, 216, DIG. 23, DIG. 42, DIG. 43

[56] References Cited

U.S. PATENT DOCUMENTS

| | | | |
|---|---|---|---|
| 4,395,064 | 7/1983 | Bellot et al. | 292/201 |
| 5,411,302 | 5/1995 | Shimada | 292/DIG. 43 |
| 5,584,515 | 12/1996 | Silye | 292/DIG. 27 |
| 5,642,636 | 7/1997 | Mitsui | 292/201 |
| 5,667,263 | 9/1997 | Kleefeldt et al. | 292/DIG. 23 |
| 5,802,894 | 9/1998 | Jahrsetz et al. | 70/278.7 |

FOREIGN PATENT DOCUMENTS

| | | |
|---|---|---|
| 0699813 | 3/1996 | European Pat. Off. . |
| 699813 | 3/1996 | European Pat. Off. . |
| 8906230 | 7/1989 | Germany . |
| 8906230 | 8/1989 | Germany . |
| 3941669 | 7/1990 | Germany . |
| 4025033 | 2/1991 | Germany . |
| 4318544 | 5/1994 | Germany . |
| 4240091 | 6/1994 | Germany . |
| 19531763 | 3/1996 | Germany . |
| 19635415 | 8/1996 | Germany . |
| 19530726 | 2/1997 | Germany . |

*Primary Examiner*—Suzanne Dino Barrett
*Attorney, Agent, or Firm*—Martin A. Farber

[57] ABSTRACT

A lock device, in particular for doors of motor vehicles, has lock elements such as at least a rotary latch and a pawl, wherein at least one lock element (a pawl) can be connected via connecting elements with at least one handle or such connection can be eliminated. An actuator device has a cam disk of the lock device, the connection being made or eliminated as a function of the cam disk.

13 Claims, 7 Drawing Sheets

CLOSING DEVICE

FIELD AND BACKGROUND OF THE INVENTION

The present invention relates to a closing device particularly for doors of motor vehicles.

Such a closing device is known from DE 196 35 415.3 (corresponding to Ser. No. 08/916,562 filed Aug. 22, 1997 Rathmann et al).

In the case of this closing device, it has happened that when a handle is operated, the coupling member between the handles jams and the operating device may thus be damaged. In the worst case it may even happen that the actuator fails completely, as a result of which the actuator no longer operates. This is of particular disadvantage from safety standpoint.

SUMMARY OF THE INVENTION

The object of the present invention therefore is to improve a closing device in such a way that its operation is assured in every operating situation and that jamming of the parts of the closing device is avoided.

According to the invention an actuator has a cam disk (6), the connection being made or eliminated as a function of the cam disk (6).

The use of a cam disk or of a contoured disk has the advantage that it acts on elements of the closing device in such a manner that at least one element of the lock can be connected to at least one handle, or such connection can be eliminated. Assurance is thus had that the element is present either in the force-transmission path between handle and lock element, and actuation of the handle is transmitted to an element of the lock (pawl) in order to open a door of the vehicle. In the second position of the element, the element is moved out of the force-transmission path between the lock element and the handle by the contoured or cam disk, so that actuation of the handle has no result. The jamming of this element between further lock elements is thus no longer possible. At the same time, all functions of the closing device, such as, for instance, anti-theft security, central lock, unlocking position and child-safety position can be realized with one or more cam or contoured disks.

As a further development of the invention, the actuator is an electric motor which bears the cam disk or the contoured disk on its setting shaft. This is an advantage since in this way a rotary construction of the parts is possible, in which a high freedom in design is possible, and with which the function and movement of the cam or contoured disk can be realized in a particularly simple manner.

As a further development of the invention, the cam disk or contoured disk can be driven stepped-down by the actuator. This has the advantage that relatively small electric motors can be used as actuators, which then apply the required torque as a result of the step-down ratio so as to turn the cam disk or contoured disk. This is of advantage, in particular in the case of a cam disk, since it can move the element in one direction with relatively little force, while movement in the opposite direction is possible only with the expending of force on the element (for instance, spring force). In order to overcome this action of force in the one direction, the disk must be capable of being driven stepped-down. As an alternative to this, it is possible, with a suitably dimensioned actuating device, also to provide a stepped-up transmission as a result of which there is obtained the advantage that a particularly rapid displacement of the element from the one position into the other position and vice versa is possible.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
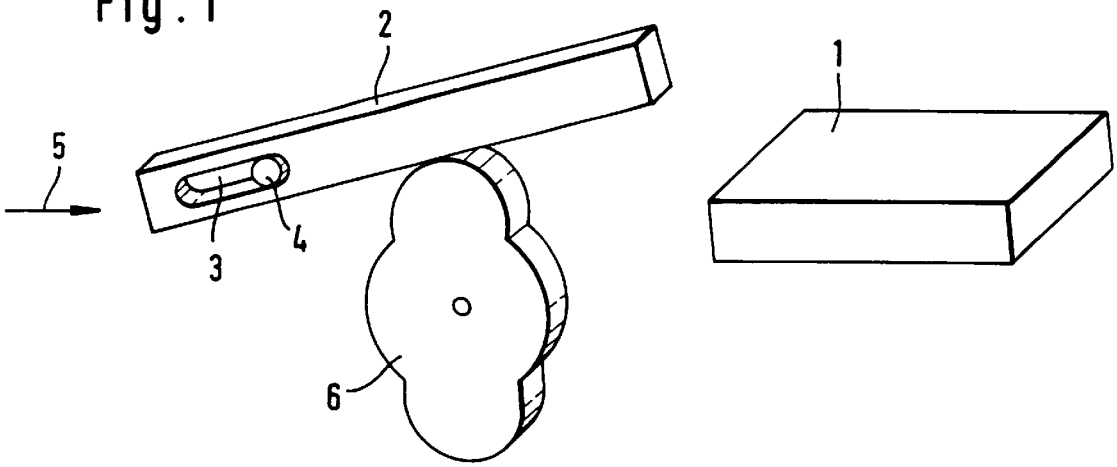
FIG. 1 shows a closing device for the actuation by a handle.

FIG. 1 shows a diagrammatically depicted closing device such as used, for instance, on car doors, trunks or the like. The manner of operation of the closing device provides that the door is provided with at least one handle (for instance, inside door handle or door outside handle), in which connection the operation of this one handle is transmitted via connecting elements (for instance, Bowden cables, rods, or the like) to a lock element. Such a lock handle may, for instance, be a pawl which, in known manner, locks or releases a rotary trap in its closed position. The rotary trap, which is developed in U-shape, surrounds by its two arms a closure bolt in order to hold the door in its closed position. After release of the rotary trap by actuation of the pawl, the closure bolt can slide out of the region of the arms of the rotary latch so that the door can be opened. The actuating of the handle can be noted, for instance, by microswitches, the output signal of which effects the control of the actuator.

Such a pawl is shown diagrammatically in FIG. 1, and provided with the reference numeral 1. In order to actuate the pawl 1, a slider 2 (or lever or the like) is provided which has a slot 3 on one end, the slider 2 being turnable around an axis of rotation in the region of the slot 3. Upon actuation of the handle in the direction of actuation 5, the slider 2 is actuated in the direction toward the pawl 1 in order to release the rotary trap by means of the pawl. Movement of the slider 2 opposite the direction of actuation 5 is effected for instance by means of spring force.

In accordance with the invention, a cam disk 6 is now provided, the outer contour of which acts on the slider 2 in such a manner that, a upon actuation of the slider 2 by means of the handle, said slider 2 can be brought into operative connection with the pawl 1 in order to open the door or to bring the slider 2 into such a position (lifted in accordance with FIG. 1) so that this connection cannot be produced or can be eliminated. In such a case, movement of the slider 2 in the direction of actuation 5 achieves nothing, so that the door remains closed. The cam disk 6 can be arranged on a shaft of an electric motor or the like and be turnable around the latter. As an alternative to this, drive by means of step-up or step-down transmission is possible, in which case, the drive of the cam disk can also be effected via friction wheels on the outer contour, this friction wheel being acted on by force in order to follow along the outer contours of the cam disk 6.

Figure 2:
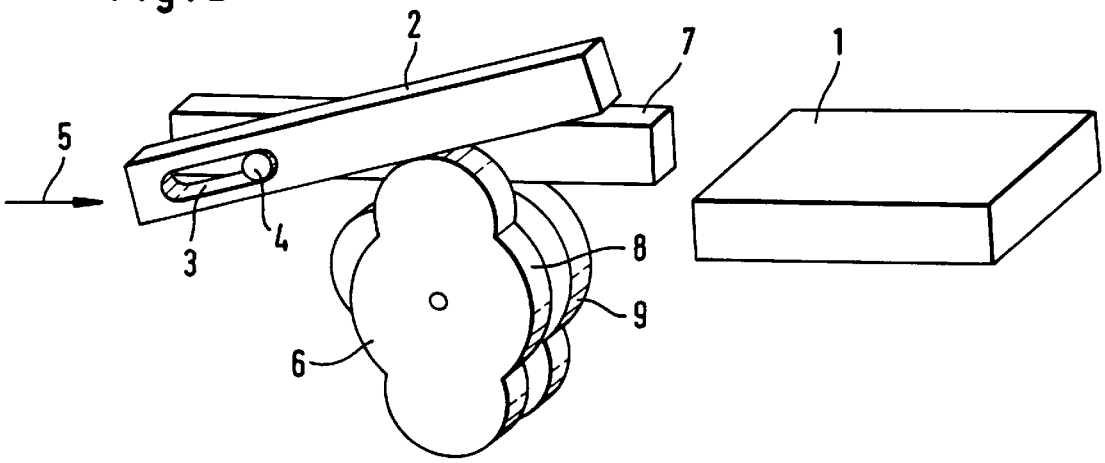
FIG. 2 shows a closing device for actuation by two handles.

FIG. 2 shows an embodiment similar to FIG. 1, but in this case the cam disk 6 has two planes which differ at least in part from each other, so that the slider 2 (which is associated, for instance, with the door inside handle), and another slider 7 (which is associated, for instance, with the door outside handle) are actuated by the cam disk, which has a first plane for the actuating of the slider 2 and a second plane 9, which differs from the first plane 8 and is associated with the slider 7. The manner of operation is the same as in FIG. 1, in which embodiment, however, the pawl 1 is now in this embodiment to be actuated either by the door inside handle and/or by the door outside handle. There could also be possible two cam disks 6—approximately in the arrangement shown in FIG. 1—which can be driven independently of each other by a separate actuating device.

Figure 3:
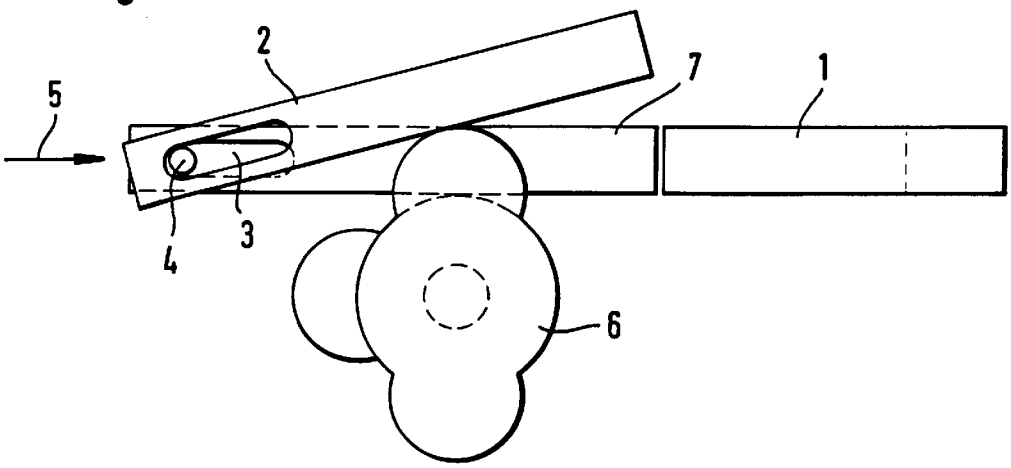
FIG. 3 shows a position of an actuated closing device.

FIG. 3 shows an embodiment in accordance with FIG. 2, in which actuation of the pawl 1 is effected by actuation of a handle in the direction of actuation 5. The contour of the second plane 9 (shown in FIG. 2) of the cam disk 8, which contour is associated with the further slider 7 makes it possible for this slider 7 to actuate the pawl 1, while the actuating of the handle which acts on the slider 2 effects nothing. This is the case, for instance, when access to the central locking position from the outside is not to be possible but, on the other hand, the opening of the door from the inside must be possible.

Figure 4:
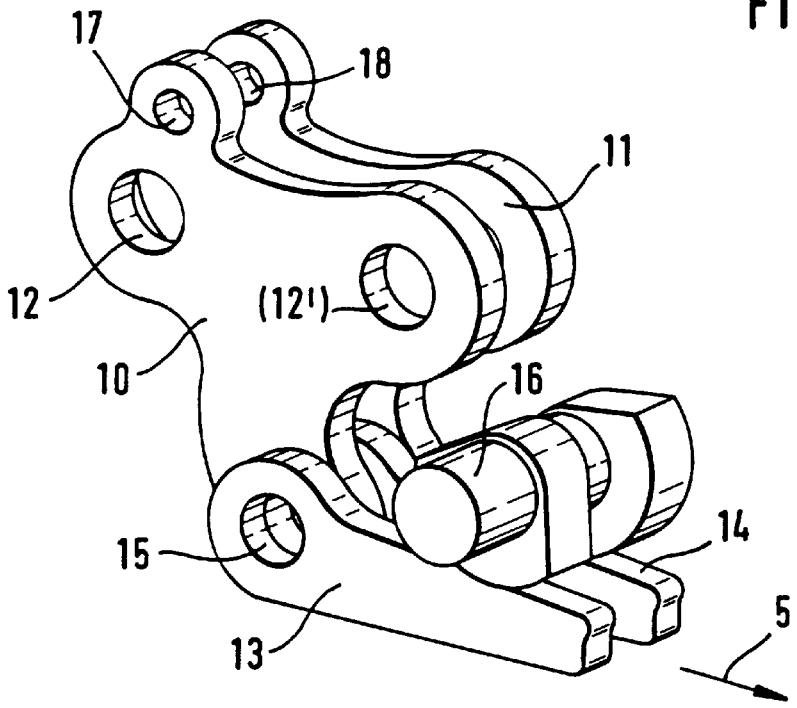
FIG. 4 shows a structural development of a closing device.

FIG. 4 shows a structural development of the closing device in which a first actuating lever 10 and a second actuating lever 11 are movable around a common axis or pivot pin 12. Actuation of a handle acts on a actuating lever in such a manner that the two actuating levers 10 and 11 are movable independently of each other. On one end of the corresponding actuating lever 10, 11, a first lever 13 is arranged around a pivot pin 15 and a second lever 14 around a pivot pin 15, so that an actuating of the handle on one or both actuating levers effects a movement of both levers 13, 14 in the direction of actuation 5. Whether such a movement is to act now on the pawl, or not, is determined by the fact that the cam disk has two planes which are at least partially different from each other in the form of a cam shaft 16, the cam contour of which acts in each case on a lever 13, 14 (or slider 2, 7). The cam shaft 16, which can be driven by the actuating device (electric motor), then brings it about that, upon the actuation of a handle, both levers 13, 14 can be brought into operating connection with the pawl 1 or not, or that only one of the two levers can be brought into operative connection and the other not, or vice versa.

In FIG. 4, it is shown that the actuating levers 10, 11 are movable around the common pivot pin 12 when connecting elements, such as, for instance, Bowden cables, rods or the like, for a lever are attached to a second point of attack 18. Upon the introduction of force on the point of attack 17 or 18, when viewing FIG. 4 from the left, a movement of the levers 13, 14 takes place in the direction of actuation 5 (substantially to the right); as an alternative to this, a common pivot pin 12' is provided so that the introduction of force on the points of attack 17, 18 is possible when viewing FIG. 4 also towards the bottom in order to effect a movement of the levers 13, 14 in the direction of actuation 5.

Figure 5:
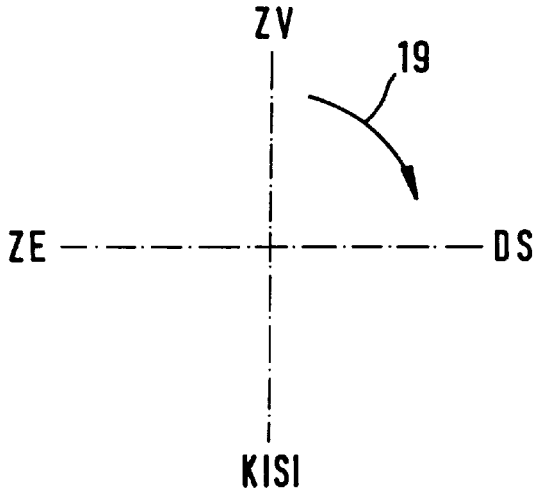
FIG. 5 shows possible positions of the actuator.

FIG. 5 shows the positions of the cam disk 6 and the cam shaft 16 respectively. Starting from a first position (for instance central lock position ZV for one or more doors), a rotation of the cam disk 6 and of the cam shaft 16 respectively takes place in the direction of rotation 19, in which case, after about ¼ of a revolution, an anti-theft position DS (in particular for all doors/trunk) takes place, after a further ¼ revolution the child-safety position KISI (in particular for the rear doors) is reached and after a further ¼ revolution the central unlock position ZE (for one or more doors) is reached. A direction of rotation 19 in only clockwise or counterclockwise direction is possible, in which case also combination thereof is conceivable (reversal of direction of rotation).

In FIGS. 6 to 11, the positions are shown which can be assumed in accordance with FIG. 5, in which case an association of the numerals with the abbreviations in FIG. 5 is effected and described.

The structural development which is shown in FIGS. 6 to 11 is based essentially on the embodiment already described in connection with FIG. 4. Supplementing the embodiment described in FIG. 4, there is also shown the pawl 1 which has a first extension 20 and a second extension 21, a window 22 being present between them. The significance and manner of operation of the these parts will be described in the following.

Figure 6:
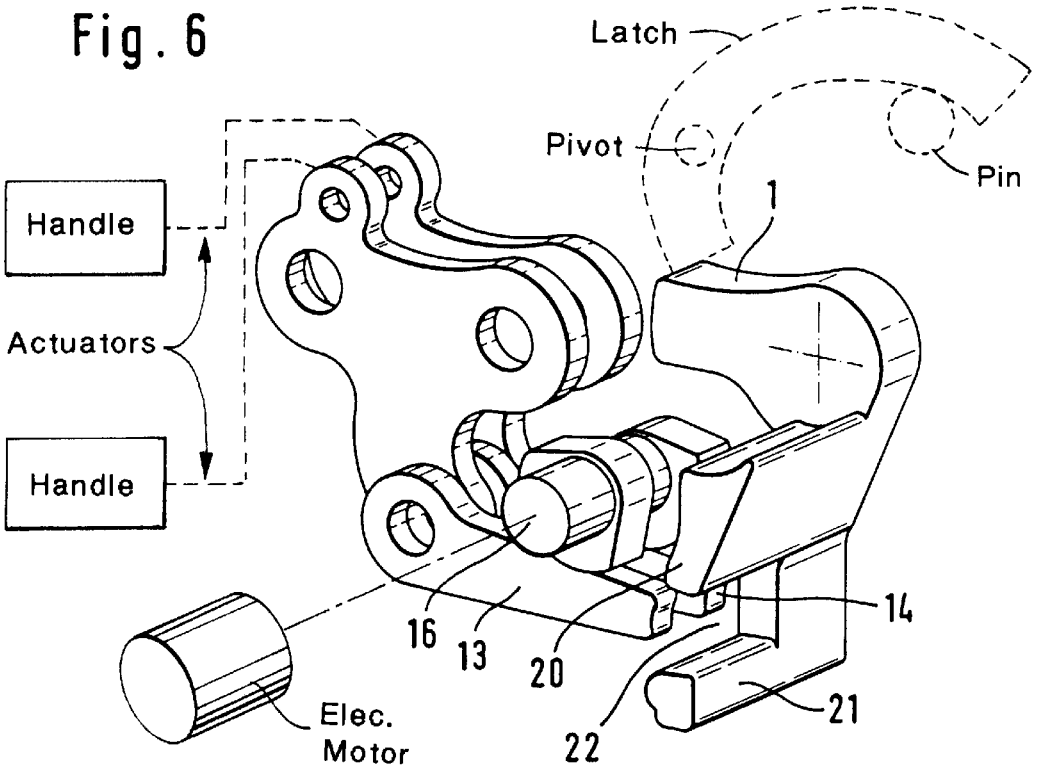
FIGS. 6 to 11 show positions of the closing device in accordance with FIG. 5.

FIG. 6 shows the anti-theft position DS. This means that the position of the cam shaft 16 provides that, upon the actuation of one or both handles, both the first and the second handles 13, 14 enter into the region of the window 22, so that the pawl 1 is not moved, and thus the door cannot be opened from either the inside or the outside.

Figure 7:
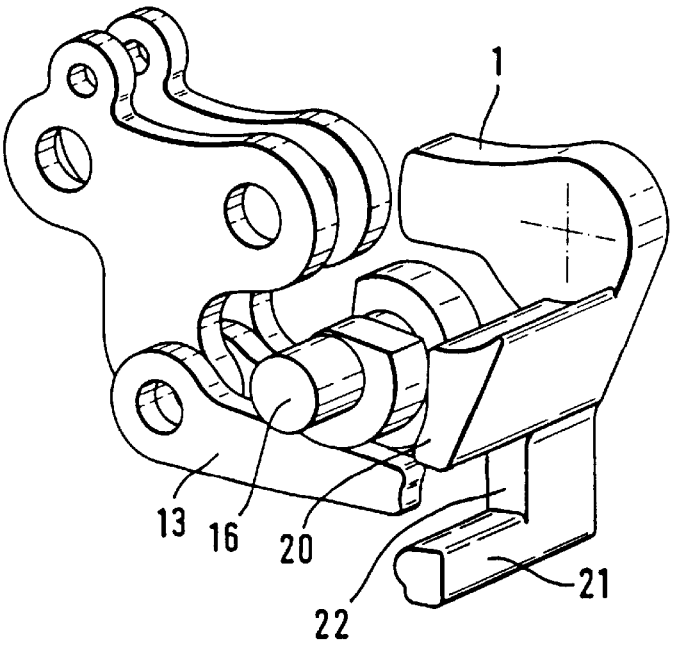

FIG. 7 shows the central locking position ZV in which, after rotation of the cam shaft 16, the cam shaft so adjusts the two levers 13, 14 that actuation of the door outside handle (first lever 13) does not permit actuation of the pawl 1, but actuation of the door inside handle 5 (second lever 14) permits actuation of the pawl 1; the door can be opened from the inside but not from the outside.

Figure 8:
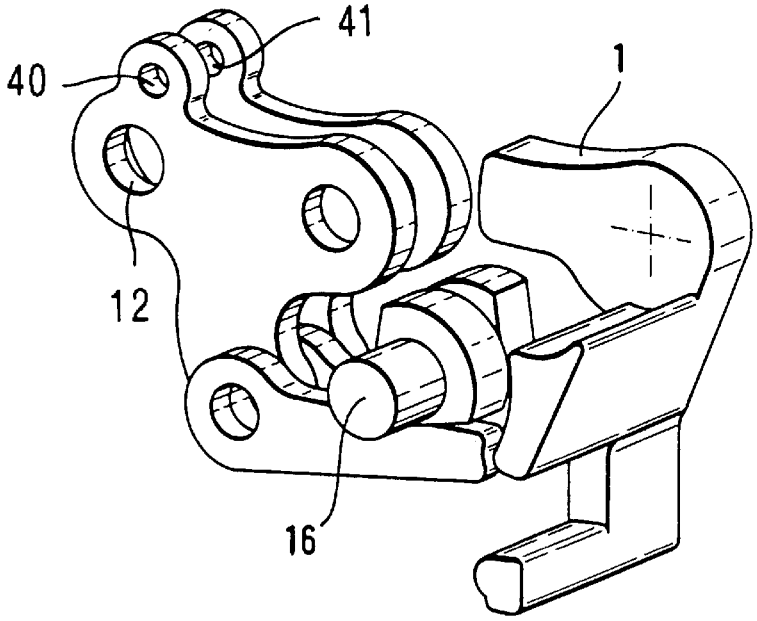

FIG. 8 shows the central unlocked position ZE in which the cam shaft 16 permits such a position of the two levers 13, 14 in which, upon actuation of the door outside handle and of the door inside handle, the pawl 1 can be actuated; the door can be opened both from the inside and from the outside. The Bowden cables attach to the door handles via elements 40 and 41. Actuation of a door handle (as by pulling on a Bowden cable) acts on the pawl 1 which releases a rotary latch and thus opens the door.

Figure 9:
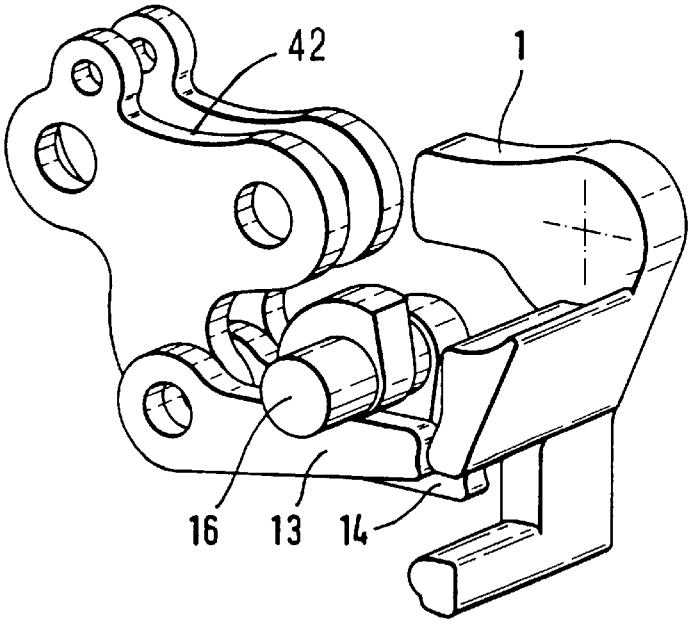

FIG. 9 shows the child-safety position KISI which makes it possible, on basis of the position of the cam shaft 16, for the door to be opened via the actuation of the door outside handle, but the door remaining closed upon actuation of the door inside handle.

Should, against all expectations, the actuator fail (for instance, failure of current which renders the electric motor inactive), it is provided, in accordance with the invention, that, for this, the pawl 1 has the aforementioned (FIG. 6) further extension 21 on which the first lever 13, or outside handles, and/or the second lever 14, or inside lever, can come to rest after actuation of a actuating device (such as, for example, a closure cylinder), now shown. A release lever is shown at 42.

Figure 10:
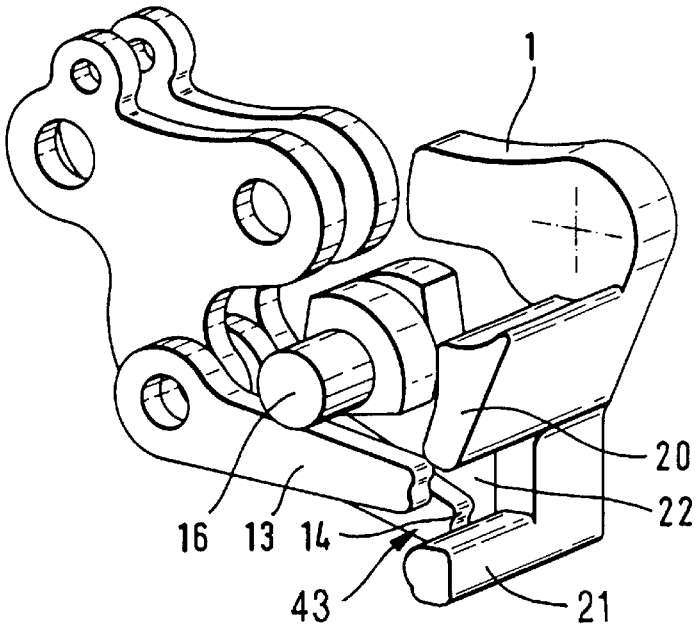

FIG. 10 shows the so-called emergency lock, in which the cam shaft 16 has remained in such a position which would actually make it possible for the first lever 13 to come to rest against with the first extension 20 of the pawl 1 in order to actuate it. Since this is not desired, the first lever 13 is brought by an actuating device into such a position that one end of the lever 13 points in the direction of the window 22, so that, for instance by means of a key, the closing device can be brought into the emergency lock position so that access to the vehicle is not possible. The closure cylinder, or the like, acts on point 43.

Figure 11:
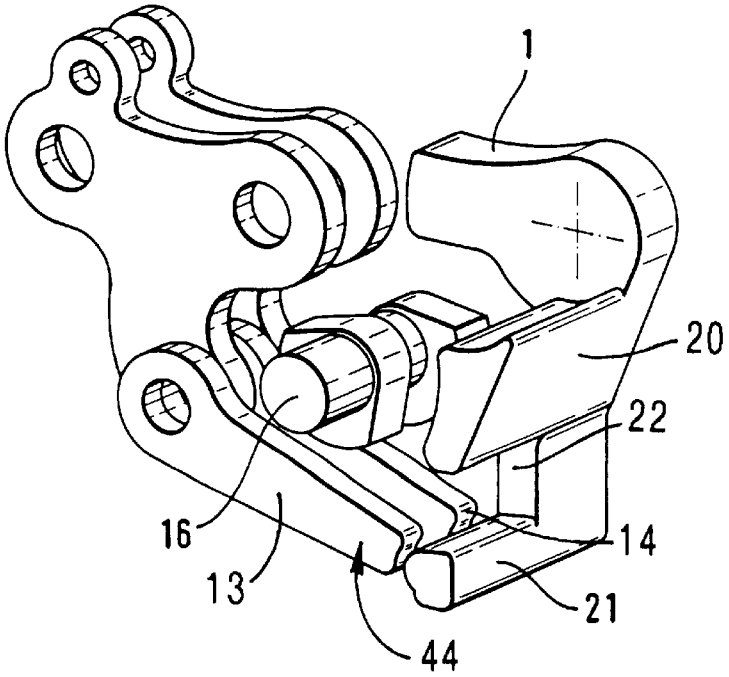

The same applies for an emergency unlock in the case of which the cam shaft 16 has remained in a position which actually does not permit actuation of the pawl 1. Thus, after swingings of at least the first lever 13, it is possible that upon actuation of the door inside handle 14 or door outside handle 13, the first lever 13 comes to rest with the second extension 21 and actuates the pawl 1. The corresponding emergency unlock position is shown in FIG. 11, wherein the closure cylinder, or the like, act at point 44.

Figure 12:
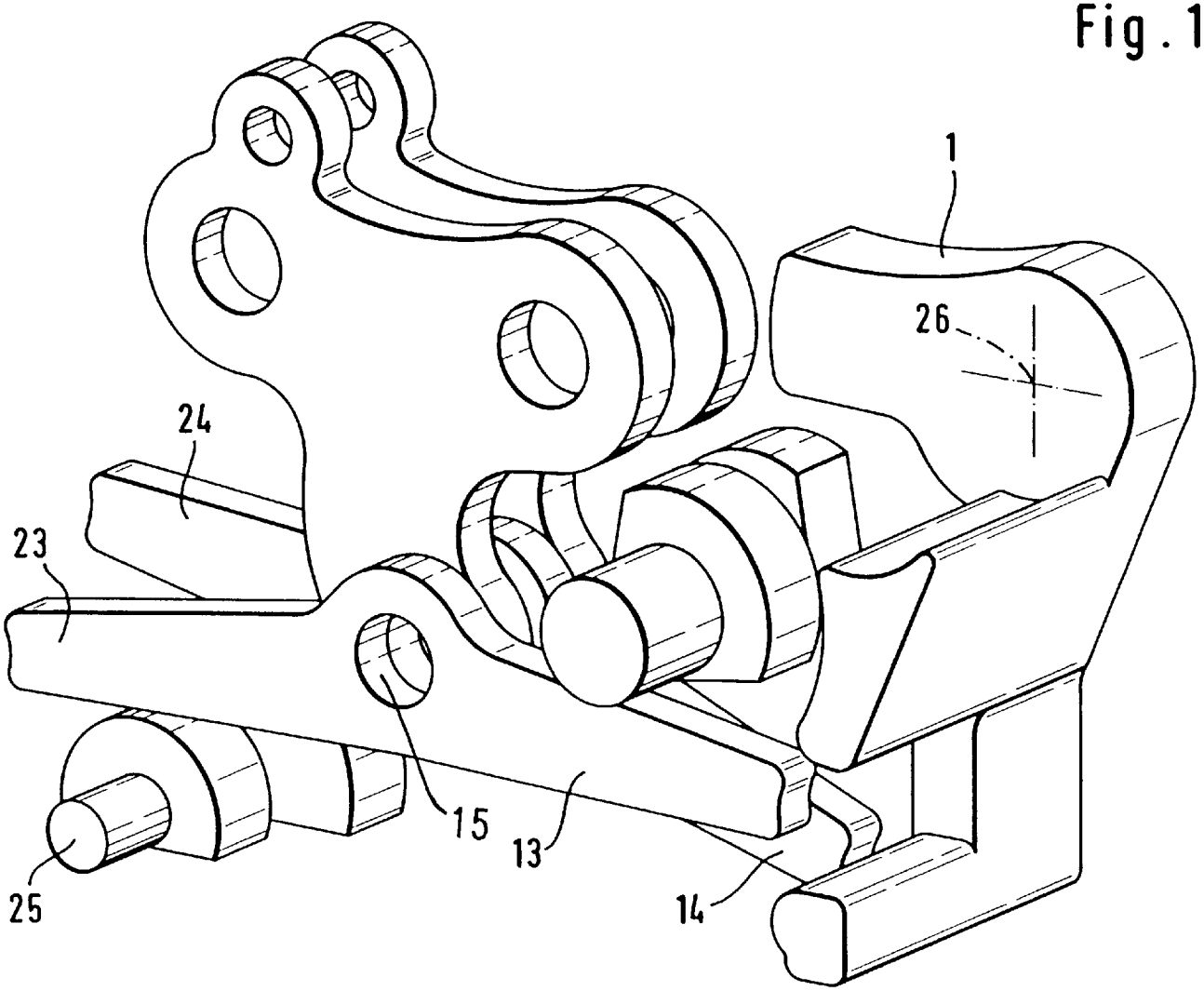
FIG. 12 shows another structural development of the closing device.

FIG. 12 shows a further development of the closing device in which, by way of supplementation of the embodiment shown in FIG. 4, both the first lever 13 and the second lever 14 have extensions 23, 24 beyond the axis of rotation 15. In the region of these extensions 23, 24 there is a further cam shaft 25, in which connection, after rotation of the cam shaft 25, the emergency lock and emergency unlock shown in FIGS. 10 and 11 can be carried out. Either the cam shaft 25 is movable via a closure cylinder or, as an alternative to this, it is also possible to provide an electric setting device with its own current supply in order to turn the cam shaft 25. In this connection, however, assurance must be had that not every unauthorized person can connect such a setting device to an additional voltage supply since access to the motor vehicle would, in principle, then be possible by means of the "emergency unlock" position.

In order to show the structural development of the pawl 1, FIG. 12 also shows a pivot pin 26 of the pawl 1, such as also present in the structures of preceding figures, though not specifically labeled.

Figure 13:
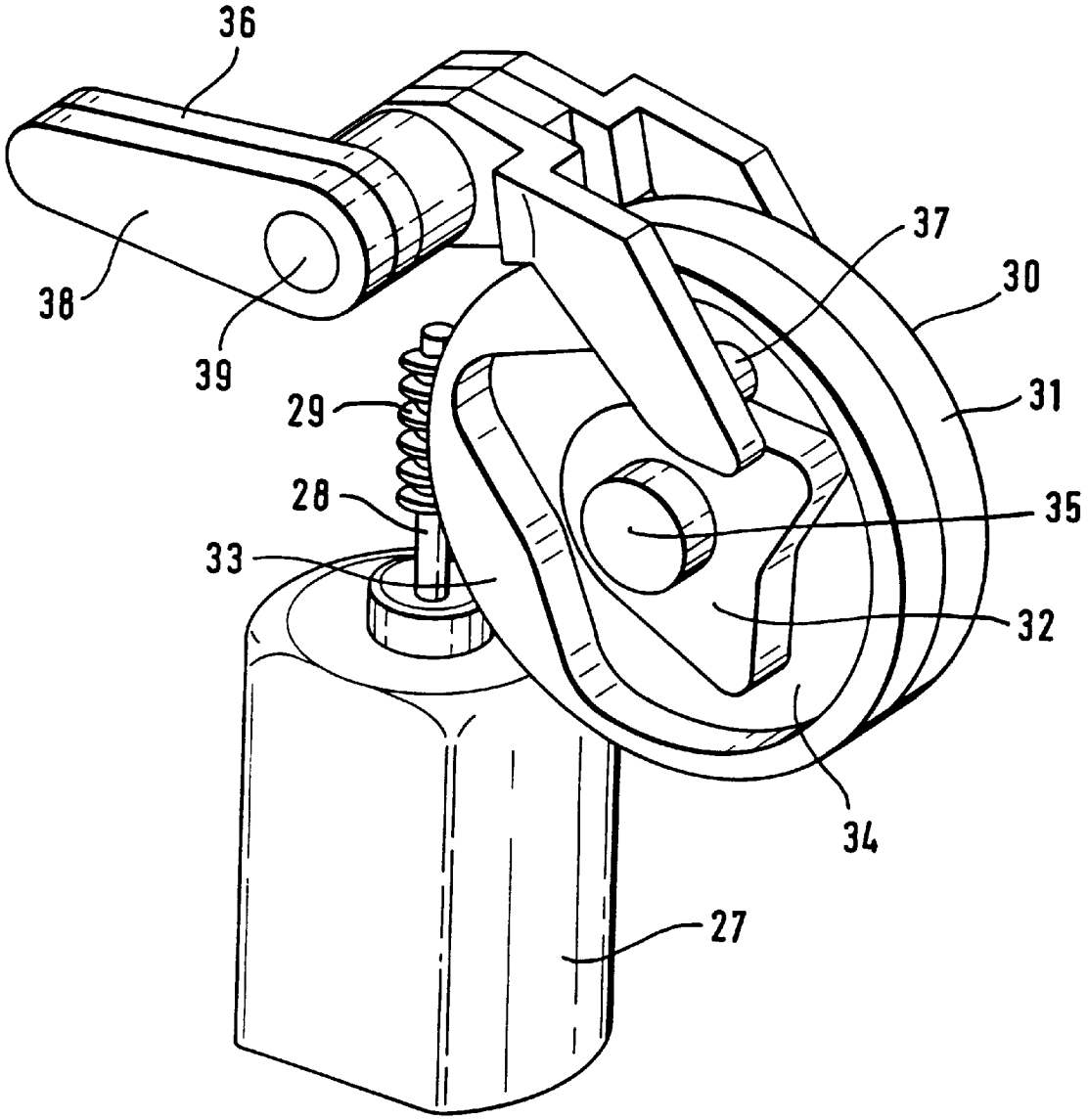
FIG. 13 shows a closing device having a contoured disk.

FIG. 13 shows a closing device having a contoured disk, the embodiment shown in FIG. 13 and described below taking the place of the cam shaft 16 or cam disk disclosed in the preceding figures.

FIG. 13 shows an electrically actuatable lock having an actuator which is developed as electric motor 27. A worm gear 29 is seated on a shaft 28 of the electric motor 27, a transmission element developed as contoured disk 30 being driven by the electric motor 27. An outer circumference 31 of the contoured disk 30 is provided with teeth (not shown in FIG. 13) which mesh with the worm gear 29 and thus form a stepped-down gearing. At least one side of the contoured disk 30 has inner elevations 32 and outer elevations 33 which form an intermediate region 34. The inner and outer elevations 32, 33 form a contour for the establishing of different functions of the lock, as will be described later on. The contoured disk 30 is mounted for rotation on a shaft 35. The reference numeral 38 designates a first lever the end of which associated with the contoured disk 30 bearing a pin 37 which extends into the intermediate region 34 and can rest on the contours of the inner elevations 32 and outer elevations 33. There is also shown in FIG. 13 a second lever 36 which is mounted with the first lever 38 on a common shaft 39 and, independently of the first lever 38, can be set by means of inner elevations and outer elevations on the other side of the contoured disk 30.

It may be mentioned here that, with the embodiment shown in FIG. 13, the actuation of the door inside handle and of the door outside handle may or may not be transmitted directly, or via the interspersion of further transmission elements, to lock elements such as, for instance, pawl/rotary latch. It is also possible to associate with an individual handle (such as, for instance, door inside handle) a separate electric motor with its own contoured disk and inner elevations and outer elevations on only one side and also only a single lever. Since the development of the lock elements does not affect the development of the actuator, a showing was dispensed with here. To make this clear, reference is had to FIG. 4, so that a lever 38, 36 acts in each case instead of the cam shaft 16 on a lever 13, 14. The development in accordance with FIG. 13 is advantageously arranged as a module in a dust-proof and splash-water protected housing with an electric plug for supplying the electric motor 27 with voltage and for reporting back the position (for instance of the contoured disk 30), the levers 38, 36 extending out of the housing in order to act on further elements.

This embodiment which is shown in FIG. 13 therefore permits an extremely flat construction which permits all functions of an electrically actuatable lock, such as unlocking, locking, and anti-theft protection (possibly also child-safety). By a corresponding control of the electric motor 27 and the movement of the levers 38 and 36 as a function of the contours of the contoured disk 30, the lock functions for two handles (such as door inside handle and door outside handle) are realized with only one actuator (electric motor 27).

What is claimed is:

1. A closing device comprising a first handle means, a second handle means, an actuator and a cam assembly driven by the actuator, a latch and a pawl engagable with the latch for effecting a locking of the closing device, a first connecting element, and a second connecting element;

wherein said first and said second connecting elements are positioned respectively along force transmission paths between said pawl and respective ones of said first and said second handle means for control of engagement between said latch and said pawl;

said cam assembly comprises first and second cam surfaces positioned for engagement with respective ones of said first and said second connecting elements; and movement of said cam assembly activates said first and said second cam surfaces for deflecting respective ones of said first and said second connecting elements from their respective force transmission paths for selection of control of engagement between said latch and said pawl by said first and said second handle means.

2. A closing device according to claim 1, wherein said actuator is an electric motor which bears the cam disk on an actuator shaft of the motor.

3. A closing device according to claim 1, wherein said cam assembly is drivable, in stepped-down fashion, by said actuator.

4. A closing device according to claim 1, further comprising a lever element connecting with said first handle means, wherein said cam assembly actuates said lever element by coming into contact or not coming into contact with one of said connecting elements as a function of a position of a cam disk of said cam assembly.

5. A closing device according to claim 4, wherein said cam assembly has two at least partially different planes, each in the form of a cam shaft, which differ at least partially from each other, and their cam contours act in each case on said lever element.

6. A closing device according to claim 4, further comprising an actuating lever, wherein said first handle means is connected with said actuating lever and said lever element is rotatably mounted on said actuating lever.

7. A closing device according to claim 4, wherein said pawl has at least a first extension (20) which contacts said lever element.

8. A closing device according to claim 4, further comprising an actuation device, wherein said pawl has second extension (21) on which said lever element rests upon actuation of said actuating device.

9. A closing device according to claim 4, wherein said lever element contacts said cam disk, and said lever element comes to rest or not to rest against said pawl as a function of a position of said cam disk.

10. A closing device according to claim 6, wherein said handle is connected with said actuating lever, said lever element being turnably mounted on said actuating lever.

11. A closing device according to claim 4, wherein said lever element is a first lever element, said closing device further comprises a second lever element, wherein said pawl has a first extension (20) against which both of said first and said second levers can come to rest.

12. A closing device according to claim 11, wherein said pawl has a further extension (21) against which either or both of said levers can come to rest by actuation of said actuator.

13. A closing device according to claim 4, wherein said lever element is a slider.

* * * * *